US011247791B2

(12) United States Patent
He et al.

(10) Patent No.: US 11,247,791 B2
(45) Date of Patent: Feb. 15, 2022

(54) HANDHELD ELECTRIC PACKING MACHINE

(71) Applicant: TAIZHOU YONGPAI PACK EQUIPMENT CO., LTD., Zhejiang (CN)

(72) Inventors: Yuhua He, Zhejiang (CN); Shuibo Jiang, Zhejiang (CN)

(73) Assignee: TAIZHOU YONGPAI PACKK EQUIPMENT CO., LTD., Zhejiang (CN)

( * ) Notice: Subject to any disclaimer, the term of this patent is extended or adjusted under 35 U.S.C. 154(b) by 107 days.

(21) Appl. No.: 16/471,412

(22) PCT Filed: Nov. 6, 2017

(86) PCT No.: PCT/CN2017/109520
§ 371 (c)(1),
(2) Date: Jun. 19, 2019

(87) PCT Pub. No.: WO2018/113428
PCT Pub. Date: Jun. 28, 2018

(65) Prior Publication Data

US 2019/0389608 A1 Dec. 26, 2019

(30) Foreign Application Priority Data

Dec. 21, 2016 (CN) ..... 201611189161.5
Dec. 21, 2016 (CN) ..... 201621405947.1

(51) Int. Cl.
*B65B 13/02* (2006.01)
*B65B 13/18* (2006.01)
*B65B 13/32* (2006.01)

(52) U.S. Cl.
CPC ..... *B65B 13/025* (2013.01); *B65B 13/187* (2013.01); *B65B 13/327* (2013.01)

(58) Field of Classification Search
CPC ..... B65B 13/02; B65B 13/025; B65B 13/18; B65B 13/187; B65B 13/32; B65B 13/322;
(Continued)

(56) References Cited

U.S. PATENT DOCUMENTS 3,554,845 A * 1/1971 Billett et al. ..... B29C 65/0636 156/580
3,654,033 A * 4/1972 Angarola ..... B65B 13/188 156/494
3,944,460 A * 3/1976 Karr ..... B29C 65/20 156/494

(Continued)

FOREIGN PATENT DOCUMENTS

CN 202358327 U 8/2012
CN 102910308 A 2/2013

(Continued)

*Primary Examiner* — Valentin Neacsu
*Assistant Examiner* — Jacob A Smith
(74) *Attorney, Agent, or Firm* — Muncy, Geissler, Olds & Lowe, P.C.

(57) ABSTRACT

A handheld electric packing machine having a strap press structure, vibrating component, cutter, and strap press spacer matching the strap press structure. The strap press structure connects to the vibrating component or is part of the vibrating component. The vibrating component is a swing vibrating component capable of rising and falling. The machine has a downward pressing mechanism and rising reset mechanism for the vibrating component. The vibrating component swings leftward and rightward relative to the lengthwise direction of a packing strap. The machine has a leftward and rightward swing driving device for the vibrating component. The machine has a manually downward pressing operating mechanism with a lock, which is locked when the vibrating component is pressed downwards until the strap press structure is located at a strap press position. The downward pressing operating mechanism cannot retreat after the manually downward pressing is removed.

12 Claims, 4 Drawing Sheets

(58) Field of Classification Search
CPC ..... B65B 13/327; B65B 13/185; B65B 13/22; B65B 13/24; B65B 67/08; B27C 27/08
USPC ..... 53/582, 592, 580, 589; 100/29, 32, 33; 156/73.5, 579, 580
See application file for complete search history.

(56) References Cited

U.S. PATENT DOCUMENTS 4,001,064 A * 1/1977 Nix ..... B29C 65/06 156/73.6
4,820,363 A * 4/1989 Fischer ..... B29C 65/0618 156/494
5,169,480 A * 12/1992 Toppel ..... B29C 65/06 156/358
5,306,383 A * 4/1994 Kobiella ..... B29C 65/0636 156/468
5,632,851 A * 5/1997 Young ..... B65B 13/327 100/29
5,653,095 A * 8/1997 Stamm ..... B65B 13/22 53/592
5,942,061 A * 8/1999 Figiel ..... B65B 13/322 156/73.5
6,079,456 A * 6/2000 Drabarek ..... B65B 13/025 140/93.2
6,338,375 B1 * 1/2002 Harada ..... B29C 66/81435 156/391
7,073,431 B1 * 7/2006 Chen ..... B65B 13/187 100/29
2003/0230058 A1 * 12/2003 Nix ..... B65B 13/188 53/582
2009/0013656 A1 * 1/2009 Nasiatka ..... B65B 13/322 53/582
2011/0100233 A1 * 5/2011 Neeser ..... B65B 13/327 100/2
2012/0210682 A1 * 8/2012 Gardner ..... B65B 13/345 53/592

FOREIGN PATENT DOCUMENTS

CN 203865041 U 10/2014
CN 104150006 A 11/2014
CN 204056351 U 12/2014
CN 204776174 U 11/2015
CN 106742437 A 5/2017
CN 206466295 U 9/2017
DE 1704048 * 11/1966 ..... B29C 27/08

* cited by examiner

HANDHELD ELECTRIC PACKING MACHINE

TECHNICAL FIELD

The present invention relates to a hand-held electric packing machine.

BACKGROUND

A hand-held electric packing machine uses a method of bundling a product or a packing piece with a PET or PP strap and then tightening and thermally bonding the two ends of the strap by friction, heating and fusion, a strap press method of a commercially available common electric packing machine welding device is that a motor is controlled by a handle operation to drive a worm gear and drive a vibrating rod of an inner wire sleeve to downwards pressing a strap, has the disadvantages a relatively complicated structure and relatively high cost.

SUMMARY

The technical problem to be solved by the present invention is to provide a hand-held electric packing machine, which may reduce the number of motors used in the hand-held electric packing machine and reduce the cost. To this end, the utility model adopts the following technical solutions:

A hand-held electric packing machine includes a strap press structure, a vibrating component, a cutter, a strap press spacer matching the strap press structure, the strap press structure is connected to the vibrating component or is a part of a vibrating component, wherein the vibrating component is a swinging vibrating component capable of rising and falling, the hand-held electric packing machine is provided with a downward pressing mechanism and a rising reset mechanism for the vibrating component, the vibrating component swings leftward and rightward relative to the lengthwise direction of a packing strap, the hand-held electric packing machine is provided with a leftward and rightward swing driving device for the vibrating component.

The hand-held electric packing machine is further provided with a manually downward pressing operating mechanism with a lock, so that the downward pressing operating mechanism is locked when the vibrating component is pressed downwards till the strap press structure is located at a strap press position, and thus the downward pressing operating mechanism cannot retreat after the manually downward pressing is removed.

Based on the above technical solution, the utility model may also adopt the following further technical solution or combine these further technical solutions:

The downward pressing operating mechanism includes a welding operating button, a cam, a rotatable bracket, a downward pressing component on the bracket and a cam-engaging component, the cam is driven to rotate by the welding operating button, and the downward pressing component acts on the downward pressing mechanism for the vibrating component;

The cam surface of the cam has a lock portion, when the vibrating component is pressed down till the strap press structure is located at the strap press position, and the lock portion comes into contact with the cam-engaging component to form locking.

The downward pressing mechanism employs a downward pressing piston, the vibrating component is hinged to the downward pressing piston, and the piston has a rising reset spring.

The downward pressing mechanism employs the downward pressing piston, the vibrating component is hinged to the downward pressing piston; the downward pressing component on the bracket flexibly presses downwards the downward pressing piston, and the piston has the rising reset spring.

The downward pressing mechanism employs the downward pressing piston, the vibrating component is hinged to the downward pressing piston; the downward pressing component on the bracket is supported on the bracket by a compressed spring, the downward pressing component flexibly presses the downward pressing piston, and the piston has the rising reset spring.

The downward pressing component has a guide rod portion and a cap-shaped pressing head at the lower end of the guide rod portion.

The strap press structure is formed at the bottom end of the vibrating component, and the lower portion of the vibrating component is provided with a mounting hole for a cutter connecting shaft, an outer sleeve of the cutter connecting shaft has a bearing and is in clearance fit with the mounting hole, and the hand-held electric packing machine is further provided with an upper and downward moving guiding structure for the cutter.

The leftward and rightward swing driving device includes a driving motor and an eccentric shaft, the eccentric shaft is provided externally with a bearing, and the vibrating component is provided with a hole matching a bearing gap, and pushes leftwards and rightwards the wall of the hole by the circular motion of the bearing under the drive of the eccentric shaft to performs vibration.

The hand-held electric packing machine is provided with a microswitch or an inductive switch, a structure in a manually downward depressing operating mechanism controls the microswitch or induces the inductive switch, the microswitch or the inductive switch control the driving motor in the leftward and rightward swinging driving device; the position of the microswitch or the inductive switch corresponds to the position of the structure matching the microswitch or the inductive switch when the vibrating component presses downwards till the strap press structure is located at the strap press position.

The hand-held electric packing machine is provided with a pressing rod supported by the compressed spring, and the pressing rod acts as the reset structure of the manually downward pressing operating mechanism.

Due to the explanation solution of the present invention, the power and control of the press strap of the utility model may be completely performed manually, without the aid of the motor, which may reduce the number of the motors used in the hand-held electric packing machine, does not need the complicated structure of the worm gear and reduces cost. Further, the utility model has the advantage of convenient operation, further, the cutting strap and the bonding of the packing strap may be completed in one step.

BRIEF DESCRIPTION FOR DRAWINGS

DETAILED DESCRIPTION

Figure 1:
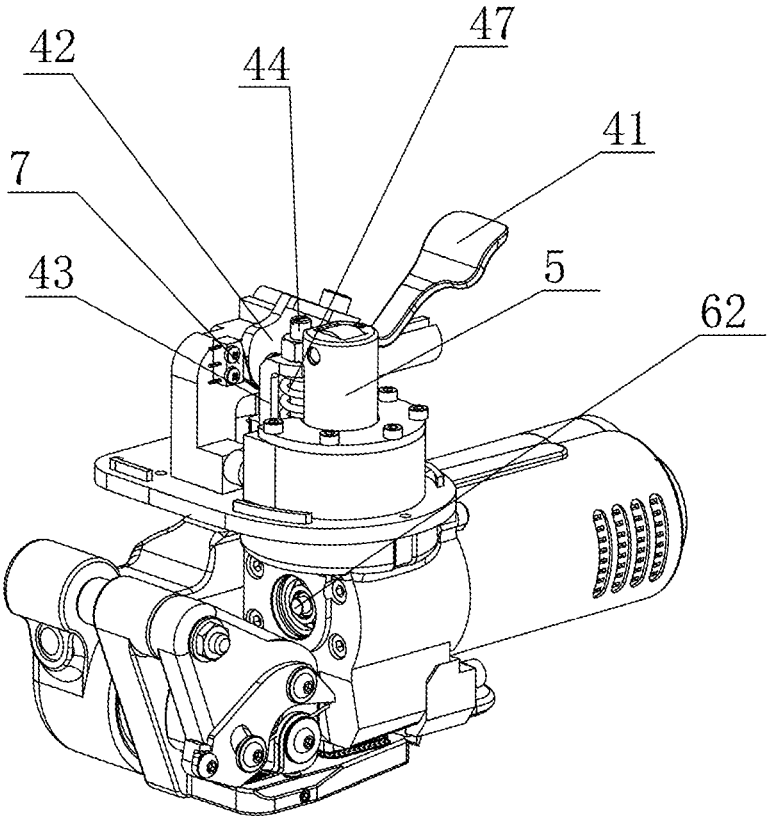
FIG. 1 is a view of an embodiment of the utility model.
Figure 2:
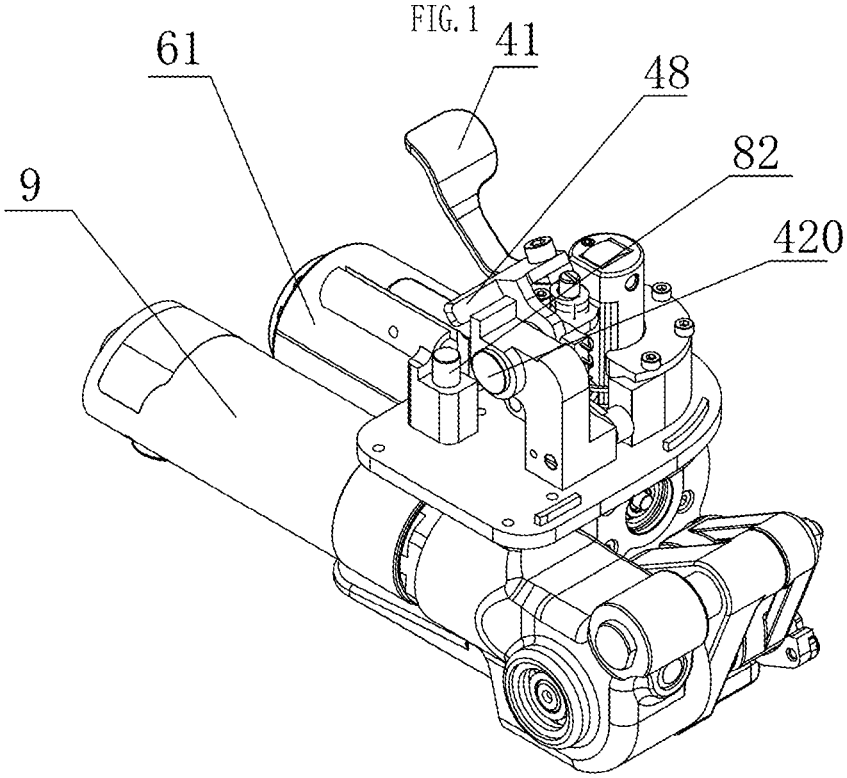
FIG. 2 is a view of another angle of an embodiment of the utility model.
Figure 3:
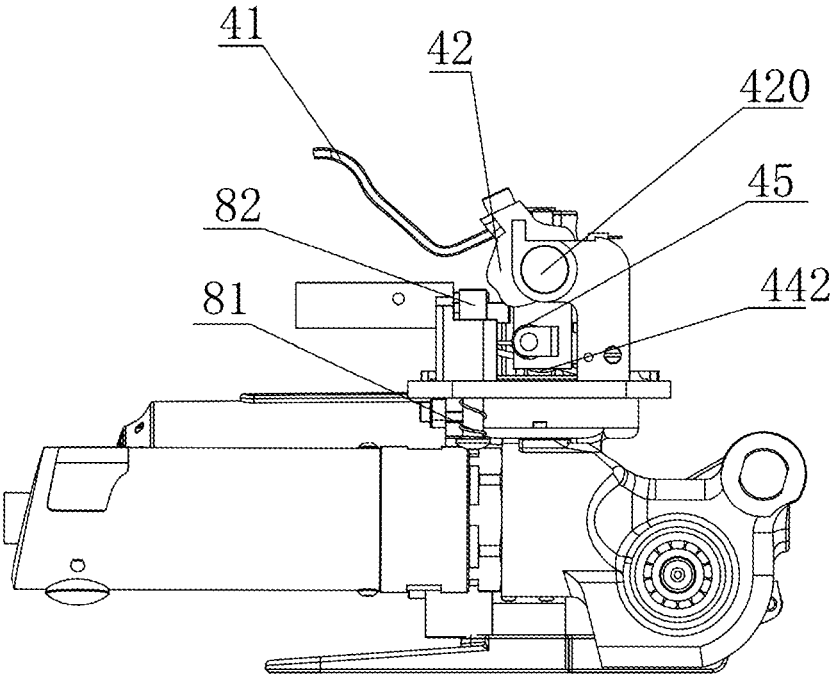
FIG. 3 is a side view of an embodiment of the utility model.
Figure 4:
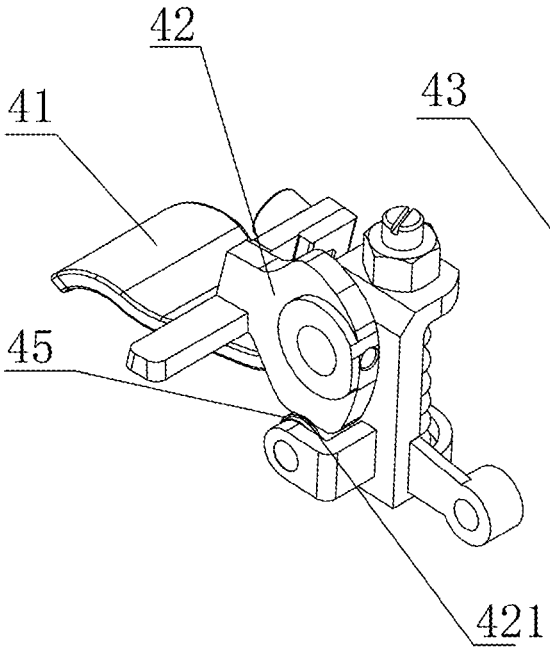
FIG. 4 is a view showing that a downward pressing operating mechanism in a locked state.
Figure 5:
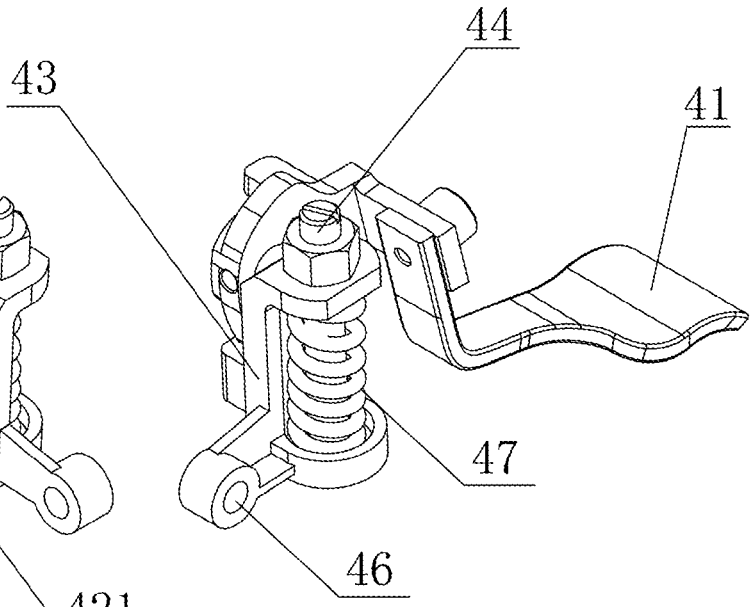
FIG. 5 is a view of another angle of a downward pressing operating mechanism in the locked state.
Figure 6:
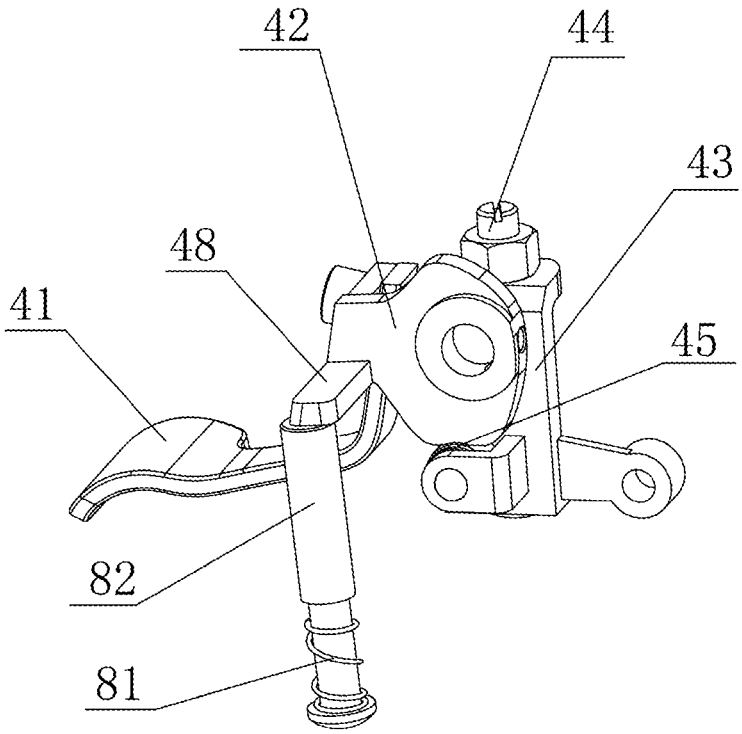
FIG. 6 is a view showing a downward pressing operating mechanism matches a pressing rod.
Figure 7:
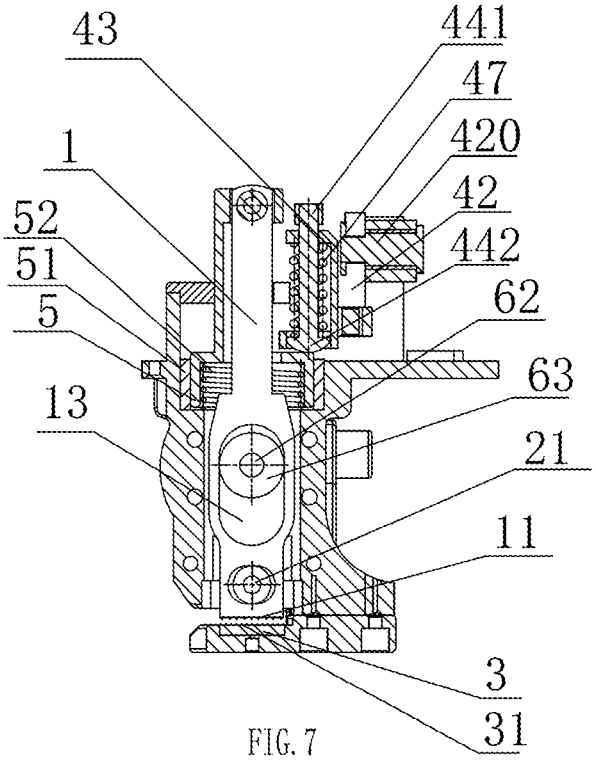
FIG. 7 is a sectional view of an embodiment of the utility model.
Figure 8:
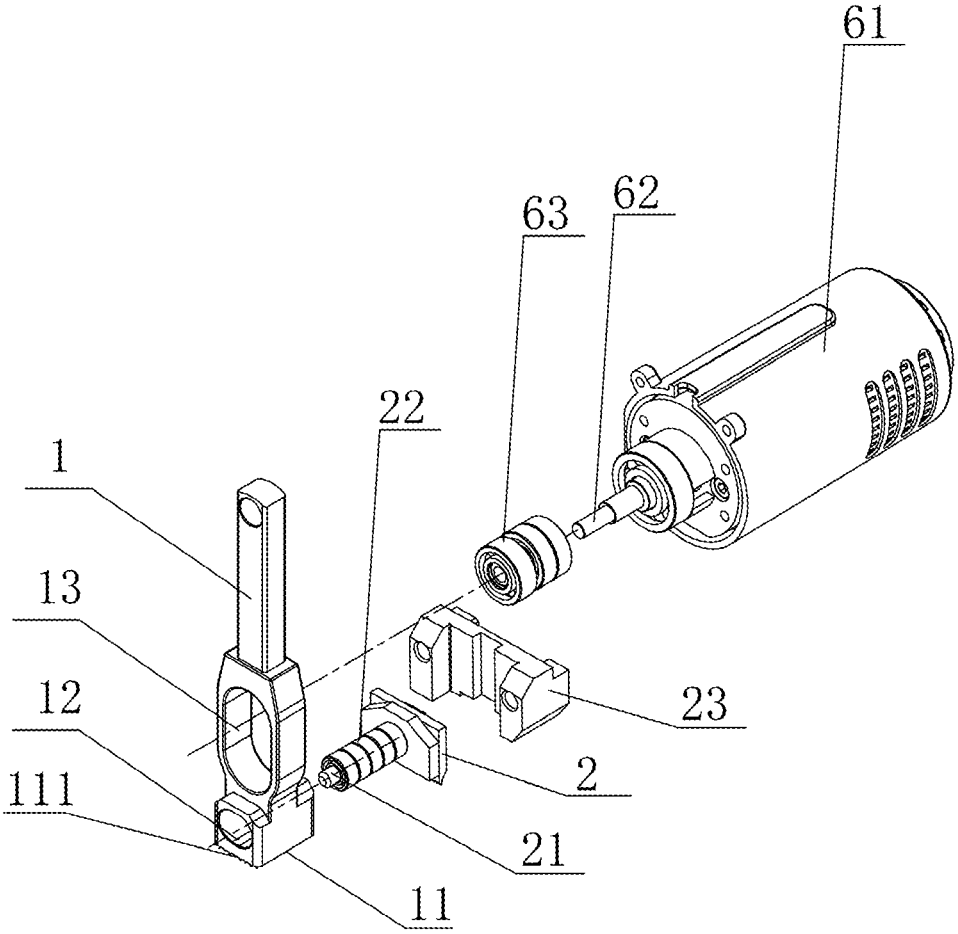
FIG. 8 is a combined exploded view of a vibrating component and a leftward and rightward swing driving device thereof.

Refer to attached drawings, a hand-held electric packing machine provided by the utility model includes a strap press structure, a vibrating component 1, a cutter 2, a strap press spacer 3 matching the strap press structure, wherein the vibrating component 1 is a swinging vibrating component capable of rising and falling, the hand-held electric packing machine is provided with a downward pressing mechanism and a rising reset mechanism for the vibrating component 1, the swinging direction of the vibrating component 1 is a left-right swing with respect to the lengthwise direction of the strap, that is, the longitudinal direction of the strap is the front-rear direction, and the vibrating component swings left and right. The swinging angle is small, and the hand-held electric packing machine is provided with a left and right swing driving device of the vibrating component;

The hand-held electric packing machine is further provided with a manually downward pressing operating mechanism with a lock, so that when the downward pressing operating mechanism is locked when the vibrating component 1 is pressed downward till the strap press structure 11 is located at a strap press position, that is, when the packing strap is pressed, at this time, a hand is released, and the manual pressing is removed, unless the manually downward pressing operating mechanism is returned to an initial state (at this time, the vibrating component 1 returns to a high position), otherwise the downward pressing operating mechanism cannot be returned, thus, the downward pressing mechanism, the vibrating component 1, and the strap press structure 3 are also locked.

The strap press structure may be a separate component connected to the bottom end of the vibrating component, the strap press structure may also directly utilize the bottom end 11 of the vibrating component, the surface of the strap press structure has friction teeth 111, and the spacer 3 of a pressing portion matching the strap press structure is also provided thereon with the friction teeth 31.

The downward pressing operating mechanism with the lock includes a welding operating button 41, a cam 42, a rotatable bracket 43, a downward pressing component 44 on the bracket 43 and a component 45 matching the cam 42, the component 45 may be a roller, the cam 42 is driven to be rotated by the welding operating button, the downward pressing component 44 acts on the downward pressing mechanism for the vibrating component 1. Reference numeral 46 is a portion where the bracket 43 is hinged to a frame of the hand-held electric packing machine, and the manually pressing range and the movement trajectory of the downward pressing component may be adjusted by adjusting the radius of rotation of the bracket 43.

The welding operating button 41 is connected to a cam shaft 421, and the cam 42 is driven to be rotated by the cam shaft 420.

The cam surface of the cam 42 has a locking portion 421, the locking portion 421 is in contact with the cam-engaging component 45 when the vibrating component 1 is pressed downward till the strap press structure is located at the strap press position, therefore, the use of the cam surface not only realizes the transmission of a manual pressing force during a downward pressing operation, but also automatically realizes the locking when entering the strap press position, so the operation is convenient and the over-position is prevented.

The downward pressing component 44 has a guiding rod portion 441 and a cap-shaped pressing head 442 at the lower end of the guiding rod portion.

The downward pressing operating mechanism may also be limited by other conventional downward pressing operating mechanisms via the control of a limit when reaching the strap press position, and then locked by a lock structure additionally, however, the operation convenience is inferior to the above embodiment.

The downward pressing mechanism adopts a downward pressing piston 5, a gap between the downward pressing piston 5 and an outer sleeve 51 thereof is small, the unnecessary vibration of the mechanism may be avoided when the vibrating component 1 is vibrated, so a working noise is reduced, and a vibration shock effect is improved, the vibrating component 1 is hinged to the centered position on the downward pressing piston. The downward pressing component 45 on the bracket flexibly presses the downward pressing piston 5. The outer sleeve 51 is arranged on the frame of the hand-held electric packing machine. The piston 5 has a rising reset spring 52.

The downward pressing component 44 on the bracket is supported on the bracket by a compressed spring 47, and the downward pressing component 44 on the bracket flexibly presses the downward pressing piston 5.

The lower portion of the vibrating component 1 is provided with a mounting hole 12 of a cutter connecting shaft 21, the outer sleeve of the cutter connecting shaft 21 has the bearing 22 and is in clearance fit with the mounting hole 12, the hand-held electric packing machine is further provided with an upward and downward guiding structure 23 of the cutter, which may be mounted on the frame of the hand-held electric packing machine frame.

The leftward and rightward swing driving device includes a driving motor 61 and an eccentric shaft 62, a bearing 63 is arranged outside the eccentric shaft 62, the vibrating component 1 is provided with a hole 13 that is in clearance fit with the bearing 63, the circular motion under the drive of the eccentric shaft 62 via the bearing 63 leftwards and rightwards pushes the wall of the hole 13 at a high frequency and a short stroke to achieve better vibration, so the structure is also simple and the cost is low.

The leftward and rightward vibration of the vibrating component 1 is not only capable of causing the strap press mechanism to rub the packing strap, causing the packing strap to be frictionally melted, but also capable of pressing the packing strap and firmly bonding the packing strap.

The hand-held electric packing machine is provided with a microswitch 7 or an inductive switch, a component in the downward pressing operating mechanism controls the microswitch or induces the inductive switch, and the microswitch or the inductive switch controls a driving motor 61 in the leftward and rightward swing driving device; the position of the microswitch 7 or the inductive switch corresponds to a position at which the component matching the microswitch or the inductive switch is located when the vibrating component 1 is pressed downward till the strap press structure 3 is located at the strap press position, the utility model uses the cam 42 to cooperate with the microswitch 7 or the inductive switch, when the vibrating component 1 is pressed downward till the strap press structure is located at the strap press position, the active portion on the cam 42 hits the microswitch 7 or induces the inductive switch, so that the driving motor 61 is turned on to perform work of friction hot melting and bonding of the packing strap. When the button 41 is pulled back by the hand, the cam 42 disengages the microswitch 7 or induces the inductive switch again, causing the driving motor 61 to stop operation.

The hand-held electric packing machine is provided with a pressing rod 82 supported by a compressed spring 81, the pressing rod 82 is taken as a reset structure of the manually downward pressing operating mechanism. The present embodiment employs a pressure plate 48 connected to the button 41, the cam 42 and the bracket 43 for engagement with the pressing rod 82. When the button 41 is pressed downwards, the pressing rod 82 is downwardly pressed, a lock portion 421 is in contact with the cam-engaging component 45 to lock the cam-engaging component 45, and the button 41 is also locked, when the button 41 is raised to cause the lock portion to be disengaged from the cam-engaging component 45, and the button 41 is raising and reset under the action of the pressing rod 82 and the compressed spring 81.

Reference numeral 9 is a drawing motor of the packing strap.

The above description is only a specific embodiment of the utility model, but the structural features of the present invention are not limited thereto, and any changes or modifications made by those skilled in the art in the art of the present invention is encompassed within the scope of protection of the utility model.

The invention claimed is:

1. A hand-held electric packing machine, comprising a strap press structure, a vibrating component, a cutter, a strap press spacer matching the strap press structure, the strap press structure is connected to the vibrating component or is a part of a vibrating component, wherein the vibrating component is a swinging vibrating component capable of rising and falling, the hand-held electric packing machine is provided with a downward pressing mechanism and a rising reset mechanism for the vibrating component, the vibrating component swings leftward and rightward relative to the lengthwise direction of a packing strap, the hand-held electric packing machine is provided with a leftward and rightward swing driving device for the vibrating component;

the hand-held electric packing machine is further provided with a manually downward pressing operating mechanism with a lock, so that the downward pressing operating mechanism is locked when the vibrating component is pressed downwards till the strap press structure is located at a strap press position, and thus the downward pressing operating mechanism cannot retreat after the manually downward pressing is removed, and the downward pressing operating mechanism comprises a welding operating button, a cam attached to the welding operating button, a rotatable bracket, a downward pressing component extending through the bracket and a cam-engaging component on the bracket, the cam is driven to rotate by the welding operating button, the cam contacts the cam-engaging component on the bracket during rotation of the cam, rotation of the cam presses the cam-engaging component on the bracket downwardly, causing the bracket to pivot along a plane parallel to a plane in which the cam rotates, pivoting of the bracket causes the downward pressing component to directly contact and act on the downward pressing mechanism for the vibrating component.

2. The hand-held electric packing machine according to claim 1, wherein the cam surface of the cam has a lock portion, when the vibrating component is pressed down till the strap press structure is located at the strap press position, and the lock portion comes into contact with the cam-engaging component to form locking.

3. The hand-held electric packing machine according to claim 2, wherein the downward pressing mechanism employs a downward pressing piston, the vibrating component is hinged to the downward pressing piston; the downward pressing component on the bracket flexibly presses downwards the downward pressing piston, and the downward pressing piston has a rising reset spring.

4. The hand-held electric packing machine according to claim 2, wherein the downward pressing mechanism employs a downward pressing piston, the vibrating component is hinged to the downward pressing piston; the downward pressing component on the bracket is supported on the bracket by a compressed spring, the downward pressing component flexibly presses the downward pressing piston, and the downward pressing piston has the rising reset spring.

5. The hand-held electric packing machine according to claim 2, wherein the downward pressing component has a guide rod portion and a cap-shaped pressing head at the lower end of the guide rod portion.

6. The hand-held electric packing machine according to claim 1, wherein the downward pressing mechanism employs a downward pressing piston, the vibrating component is hinged to the downward pressing piston, and the downward pressing piston has a rising reset spring.

7. The hand-held electric packing machine according to claim 1, wherein the strap press structure is formed at the bottom end of the vibrating component, and the lower portion of the vibrating component is provided with a mounting hole for a cutter connecting shaft, an outer sleeve of the cutter connecting shaft has a bearing and is in clearance fit with the mounting hole, and the hand-held electric packing machine is further provided with an upper and downward moving guiding structure for the cutter.

8. The hand-held electric packing machine according to claim 1, wherein the leftward and rightward swing driving device comprises a driving motor and an eccentric shaft, the eccentric shaft is provided externally with a bearing, and the vibrating component is provided with a hole matching a bearing gap, and pushes leftwards and rightwards the wall of the hole by the circular motion of the bearing under the drive of the eccentric shaft to performs vibration.

9. The hand-held electric packing machine according to claim 1, wherein the hand-held electric packing machine is provided with a microswitch or an inductive switch, a structure in a manually downward depressing operating mechanism controls the microswitch or induces the inductive switch, the microswitch or the inductive switch control the driving motor in the leftward and rightward swing driving device; the position of the microswitch or the inductive switch corresponds to the position of the structure matching the microswitch or the inductive switch when the vibrating component presses downwards till the strap press structure is located at the strap press position.

10. The hand-held electric packing machine according to claim 1, wherein the hand-held electric packing machine is provided with a pressing rod supported by a compressed spring, and the pressing rod acts as the reset structure of the manually downward pressing operating mechanism.

11. The hand-held electric packing machine according to claim 1, wherein a direction in which the downward pressing component extends and a direction in which the vibrating component extends are non-coaxial with respect to each other.

12. The hand-held electric packing machine according to claim 1, wherein the downward pressing component is not provided on a direction in which the vibrating component extends.

* * * * *